United States Patent [19]

Grace, Sr.

[11] Patent Number: 4,667,440

[45] Date of Patent: May 26, 1987

[54] GATE OPENING AND CLOSING SYSTEM

[76] Inventor: Forbes D. Grace, Sr., 1544 Delaware Ave., Jackson, Fla. 32210

[21] Appl. No.: 797,902

[22] Filed: Nov. 14, 1985

[51] Int. Cl.[4] ..... E05F 1/04

[52] U.S. Cl. ..... 49/237; 49/139; 49/357; 49/396

[58] Field of Search ..... 49/237, 236, 386, 139, 49/357, 396, 238, 25, 239, 240

[56] References Cited

U.S. PATENT DOCUMENTS

| | | | |
|---|---|---|---|
| 1,883,792 | 10/1932 | Jobes | 49/238 X |
| 2,925,674 | 2/1960 | Madden | 49/237 X |
| 4,231,190 | 11/1980 | Tieben | 49/25 |
| 4,458,448 | 7/1984 | Proulx | 49/237 |
| 4,520,592 | 6/1985 | Holloway | 49/25 X |

*Primary Examiner*—Philip C. Kannan
*Attorney, Agent, or Firm*—Arthur G. Yeager

[57] ABSTRACT

A remotely operated gate opening and closing system including a gate post with two vertically spaced helical slots through the walls of the post, a slideable and rotatable spindle concentrically inside the gate post, two L-shaped pins attached to the spindle and extending outwardly through the slots, a swinging gate with two eye supports pivotally connected to the two L-shaped pins, two spaced lever arms rigidly connected to the swinging gate and having a lug projecting horizontally outwardly toward the gate post, a locking bar selectively manually attachable to lock each lug to its respective L-shaped pin, a vertically reciprocating rod attached to the spindle, and a power drive for moving the rod.

33 Claims, 7 Drawing Figures

GATE OPENING AND CLOSING SYSTEM

BACKGROUND OF THE INVENTION

Gates in security fences, e.g., chain link fences, that must be opened to allow vehicles to pass through are usually large and cumbersome to move. Although there have been systems devised to open and close such gates remotely, the systems have been awkward, dangerous, and aesthetically unpleasant. Such systems and devices are shown in U.S. Pat. Nos.:

554,180; 2,683,945;
1,146,716; 4,231,150;
1,858,896; 4,285,165;
1,883,792; 4,416,085;
2,086,061; 4,520,592;
2,520,642.

Another difficulty encountered with swinging gates of any substantial size is that they inevitably will sag at the free swinging end and drag on the ground, making it very difficult to move the gate. Some of the above cited prior patents recognize this problem and provide means to overcome the difficulty. None of the foregoing inventions are believed to be completely satisfactory.

It is an object of this invention to provide a novel device for opening and closing a swinging gate. Another object of this invention is to provide an efficient means for remotely controlling the movement of a swinging gate and to overcome problems of sagging. Still other objects will become apparent from the more detailed description of this invention which follows.

BRIEF DESCRIPTION OF THE INVENTION

This invention relates to a gate opening and closing system having a vertical, tubular, cylindrical gate post including two vertically spaced helical slots through the wall of the tubular post, a spindle rotatable and slideable concentrically inside the post and extending lengthwise about the same distance as the vertical space between corresponding portions of the slots, two L-shaped gate hanging pins respectively rigidly connected to the spindle and extending laterally outward through respective slots with the free leg of the L being vertical and the leg attached to the spindle being horizontal; means for attaching the gate to the vertical legs of the L-shaped pins, a vertically reciprocable and rotatable rod member attached to the spindle, and electric power means to drive the rod member. Preferably the gate includes two spaced horizontal arms each having a bearing for rotatable engagement with the L-shaped pin and having a projecting lug extending toward and in proximity to but not operatively engaged in the helical slot. A locking bar is removably positionable over each lug and the horizontal leg of its respective L-shaped pin to provide the option of operating the gate by a power drive or manually.

In a specific embodiment of this invention the helical slots are fashioned to cause the first opening movement of the gate to be one in which the gate is lifted substantially vertically and then swung to an open position. In another embodiment the arms attached to the gate include a bearing engaging the L-shaped pin in the middle of a yoke member having two diverging yoke arms, a coil spring on each yoke arm, a turnbuckle attached to each spring, and an elongated flexible cable extending under tension from each turnbuckle to a portion of the gate adjacent its free swinging side. This arrangement provides enough flexibility for a person to open the gate, even though the locking bar is in place, sufficiently for a person to walk through.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
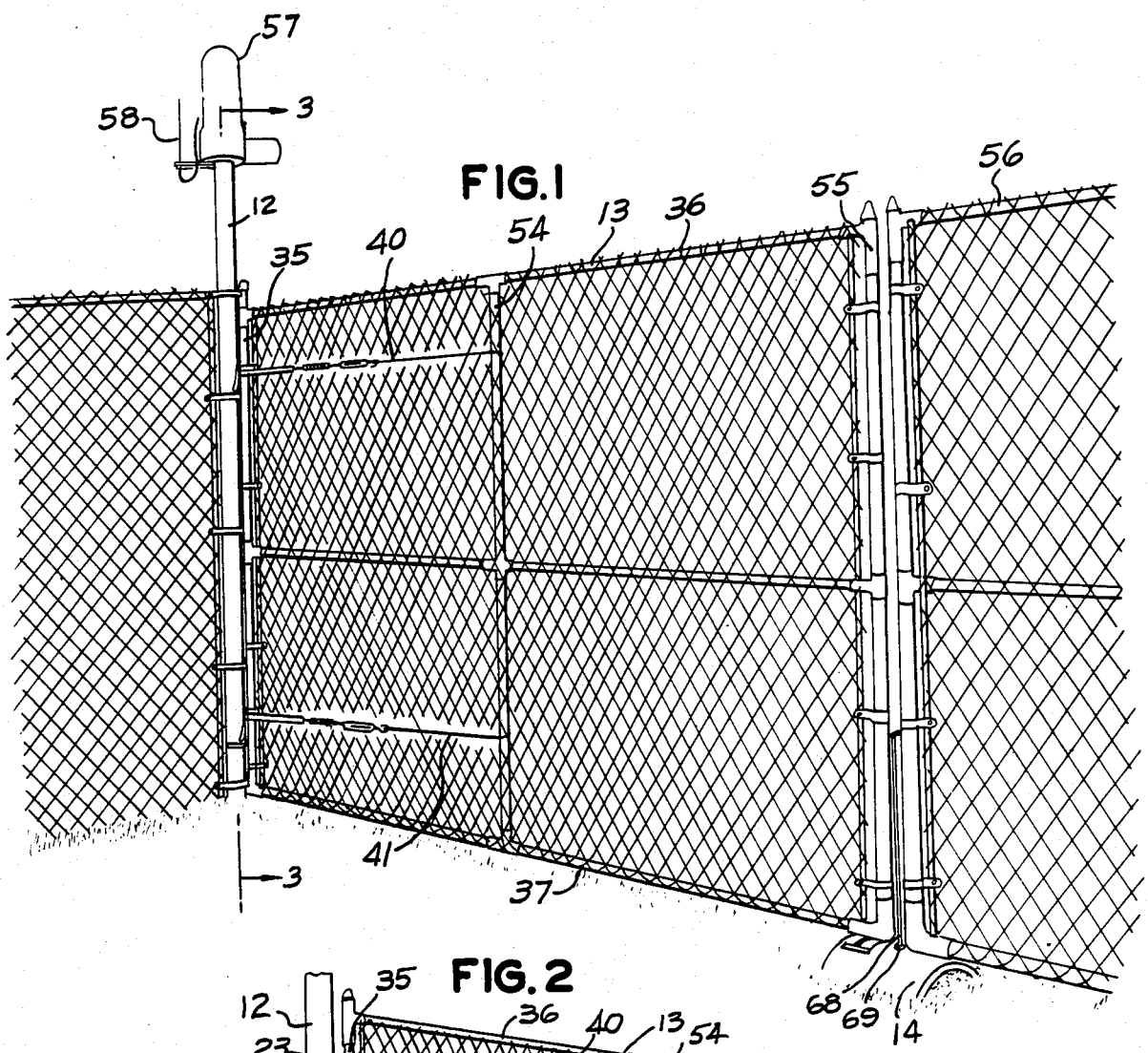
FIG. 1 is a perspective view of the gate opening and closing system according to this invention, with the gate in closed position.
Figure 2:
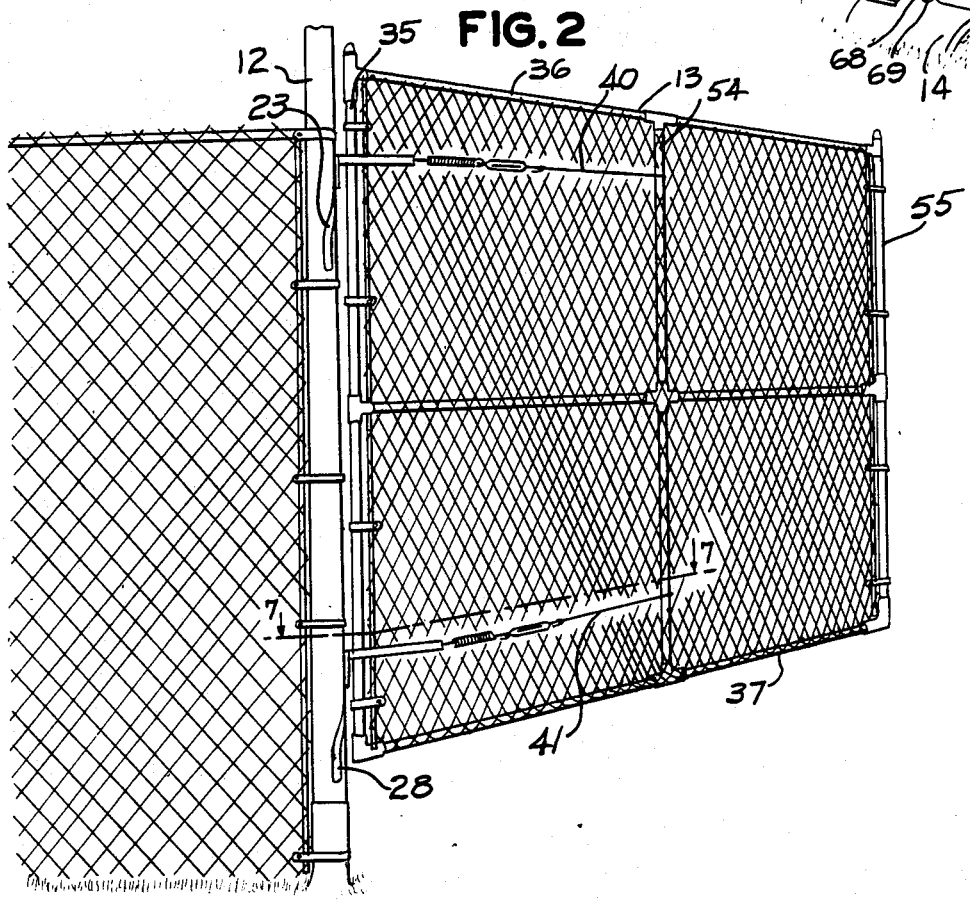
FIG. 2 is a perspective view similar to FIG. 1 showing the gate in an open position.

The general overall view of this invention as it applies to a gate in a fence is shown in FIGS. 1 and 2. A chain link fence has two gates 13 and 56 which swing open. Gate 13 is remotely controlled while gate 56 is manually controlled. Gate stop 14 rests on the ground where the two gates 13 and 56 are positioned when the gates are closed. A remotely controlled motor is located in housing 57 and drives the apparatus for opening and closing gate 13. Gate post 12 contains an internal mechanism which causes gate 12 to swing open or closed upon a radio signal picked up by antenna 58. The internal mechanism (described in detail below) causes gate 13 to swing in a fashion guided by helical slots 23 and 28. Leverage devices 40 and 41 are employed to facilitate the opening and closing of a large heavy gate.

Figure 3:
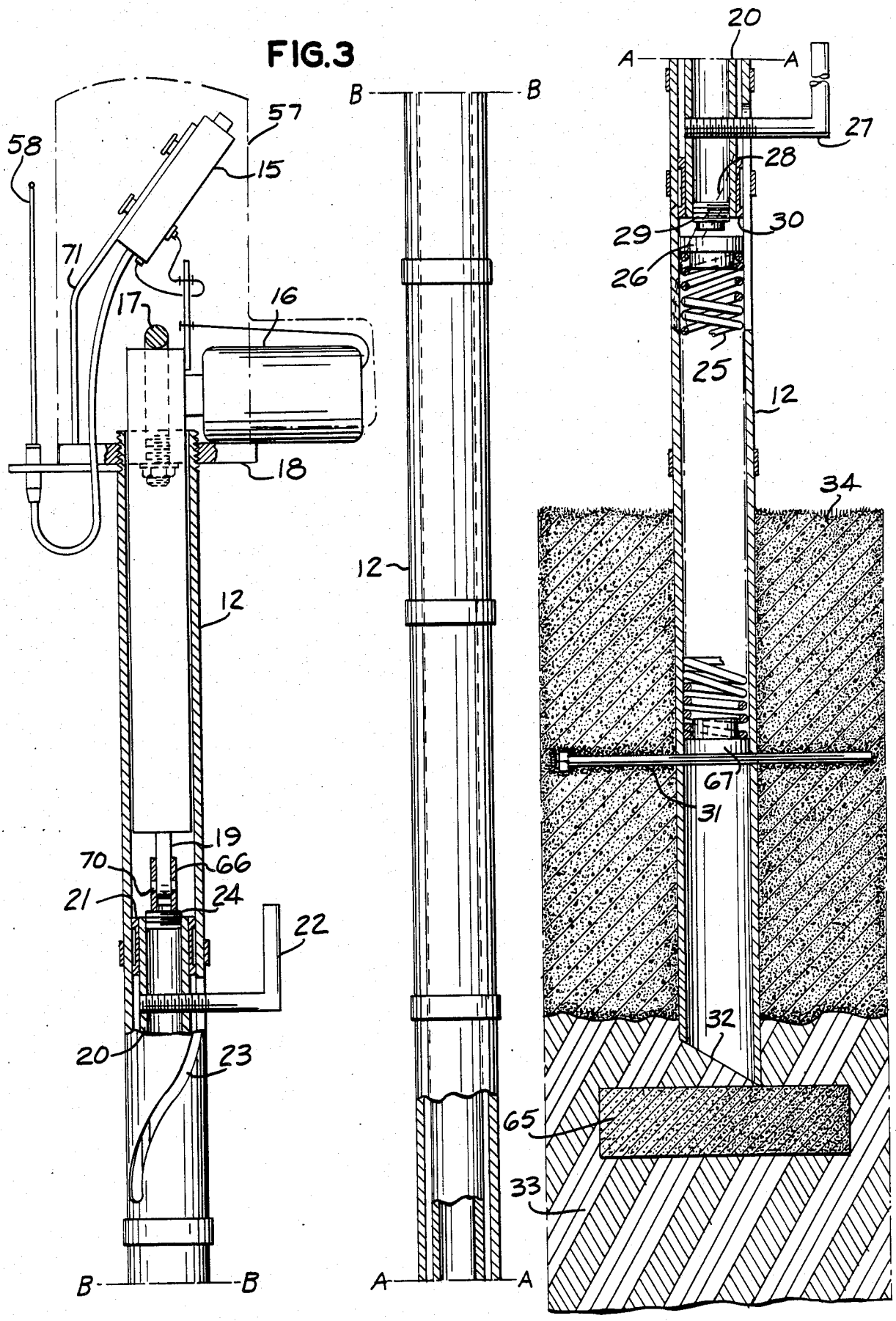
FIG. 3 is an enlarged cross-sectional view taken along line 3—3 of FIG. 1.

In FIG. 3 there is shown the internal mechanism for moving gate 13. Gate post 12 is a hollow tubular pipe having an internal spindle 20 which is mounted concentrically inside bushings 21 and 30 at the upper and lower ends of the spindle, respectively. Spindle 20 and bushings 21 and 30 move longitudinally and rotatably inside post 12. L-shaped pins 22 and 27 are fastened to spindle 20, preferably by a threaded connection on the horizontal leg of the pin. The vertical legs of pins 22 and 27 are pointed upward to function as pivot pins to support gate 13. Pins 22 and 27 extend outwardly of post 12 through helical slots 23 and 28, respectively. The upper end of spindle 20 is connected to a power driven vertically reciprocable and rotatable rod 19. Any suitable connecting means is operable. The one shown here includes a plug 24 screwed into the upper end of spindle 20 and a bifurcated coupling 66 fastened by a suitable connecting pin 70 to rod 19. Rod 19 is driven by a mechanism (not shown) operated by an electric motor 16 connected to a commercial source of electric power (not shown). A suitable commercially available apparatus for motor 16 and rod 19 is a Linear Activator DC Model having an adjustable travel of up to 12 inches maximum, made and sold by Dayton Electric Manufacturing Company of Chicago, Ill. An electronic radio signal receiver 15 activates motor 16 upon receipt of an appropriate signal through antenna 58 from a remote signal source, such as that in a vehicle approaching the gate. An appropriate location for receiver 15 and motor 16 is at the top of gate post 12 and enclosed in a suitable housing 58 to protect it from the weather. A support plate 18 is screwed to the top of post 12 and a U-bolt fastener 17 clamps motor 16 thereto. Receiver 15 is supported by arm 71 connected to plate 18.

The lower end of gate post 12 is set into the ground preferably in a cement footing 34 with the bottom of post 12 having an open end 32 resting on a brick or cement block 65 in a porous layer 33 of packed drainage material, such as gravel, aggregate, etc. This provides a convenient method of providing a continuous drainage for any water inside of post 12. At the bottom end of spindle 20 there is a pipe plug 29 screwed or welded to spindle 20. Compression coil spring 25 is enclosed in post 12 to provide a power boost assistance in opening gate 13. At the bottom of spring 25 there is a striker plate 67 supported on cross bolt 31 piercing post 12 within footing 34. At the top of spring 25 there is a striker plate 26 which is pressed against plug 29 except when gate is fully open as shown in FIG. 3. When gate 13 is closed L-shaped pins 22 and 27 will be at the bottom of slots 23 and 28, respectively, which, in turn, will cause spring 25 to be compressed. When gate 13 is to be opened the energy of spring 25 will assist motor 16 in moving spindle 20 upwardly so as to bring L-shaped pins 22 and 27 to the upward ends of slots 23 and 28 with gate 13 open.

Figure 4:
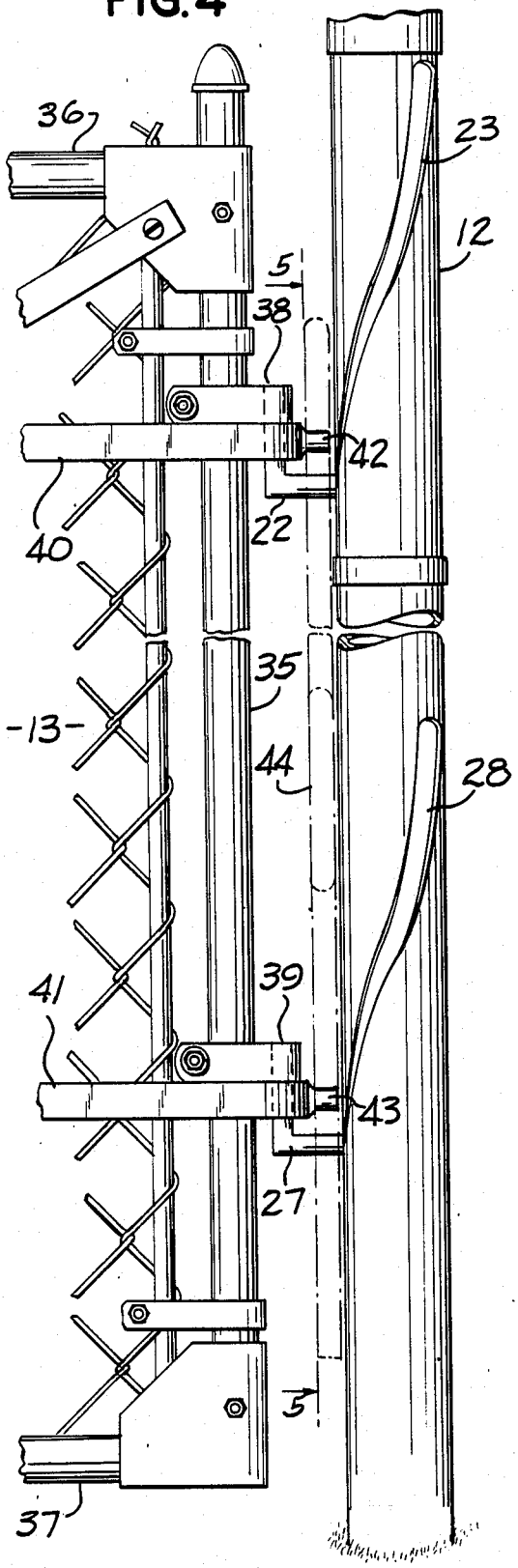
FIG. 4 is an enlarged front elevational view of the gate post and gate connections according to this invention, with the central portion of the gate post and gate removed for clarity of illustration.
Figure 6:
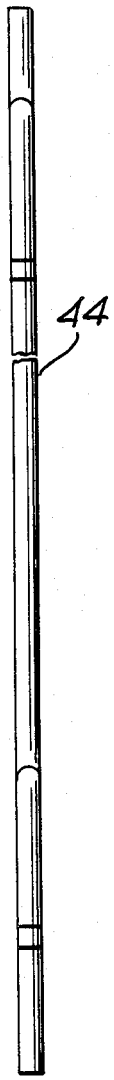
FIG. 6 is a side elevational view of the locking bar in FIG. 5.
Figure 7:
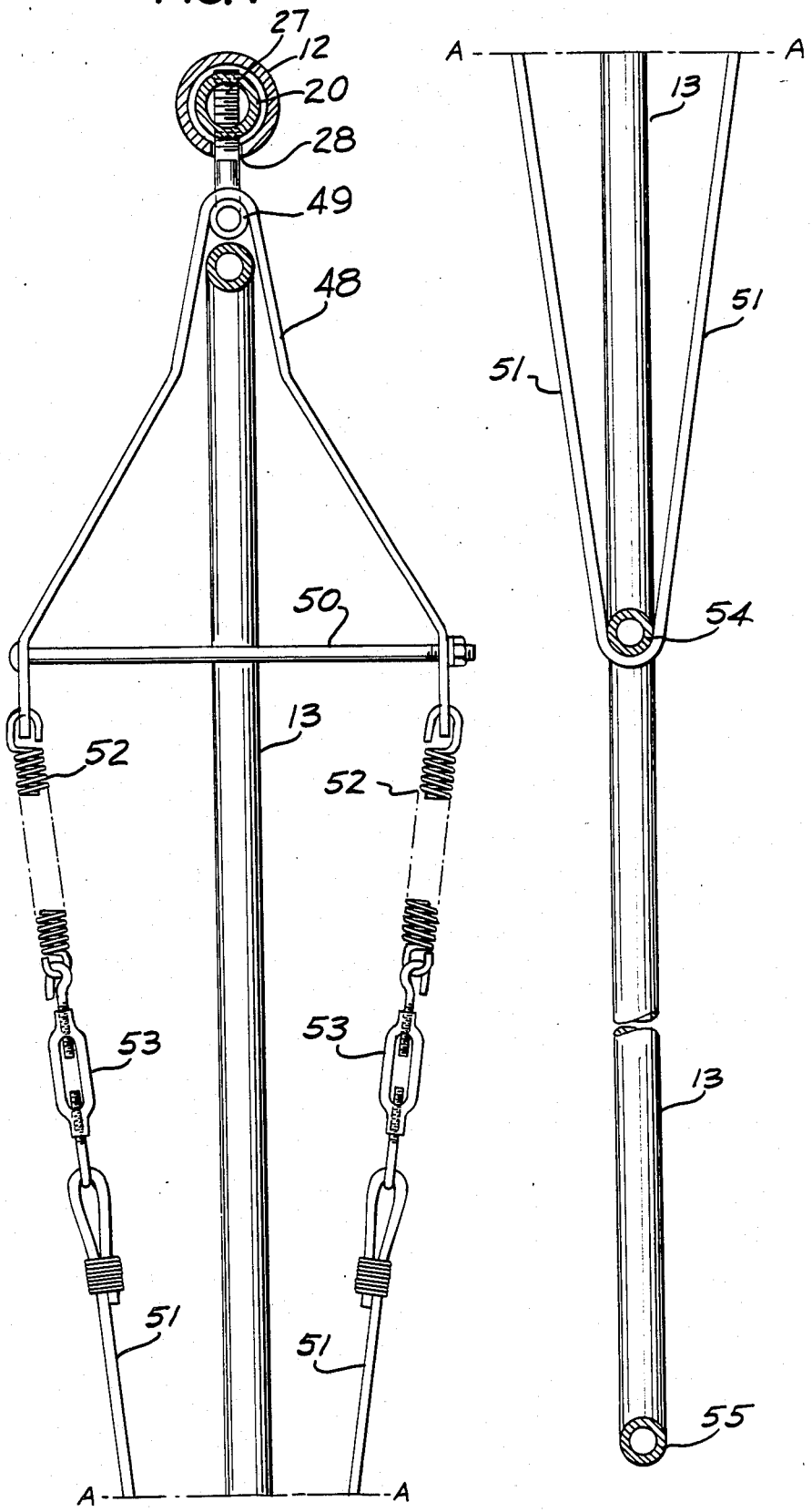
FIG. 7 is a cross-sectional view taken along line 7—7 of FIG. 2.

In FIGS. 4 and 7 there are shown some of the details of gate 13 and its relationship to gate post 12. Gate post 12 has slots 23 and 28 from which L-shaped pins 22 and 27, respectively, project outwardly. Each pin 22 and 27 has its horizontal leg attached rigidly to spindle 20 inside post 12, and its free leg pointing vertically upward. Gate 13 is bounded by four pipe frame members; upper and lower horizontal members 36 and 37, and inner and outer vertical members 35 and 55 (see FIG. 1). Inner frame member 35 supports an upper eye hanger 38 and a lower eye hanger 39, which fit respectively over the free legs of L-shaped pins 22 and 27. Eye hangers 38 and 39 function as the pivotal support upon which gate 13 freely swings to its open and closed positions. Upper and lower leverage arms 40 and 41 help to control and facilitate the movement of gate 13. Each leverage arm 40 and 41 has, as best seen in FIG. 7, a yoke 48 of two diverging arms, one on each side of gate 13, held apart by cross piece 50, two lengths of coil spring 52, two turnbuckles 53, and a length of flexible cable 51 which makes a turn about vertical frame member 54 of gate 13. At gate post 12 each yoke 48 of arms 40 and 41 includes a bearing 49 which slides rotatably over the free end of L-shaped pin 22 and 27, respectively. Projecting outwardly from each arm 40 and 41 toward slots 23 and 28, respectively, is lug 42 and 43, respectively. Lugs 42 and 43 do not contact slots 23 and 28, but generally are in alignment with and directly above the horizontal arms of L-shaped pins 22 and 27. This arrangement of arms 40 and 41 with springs 52 and turnbuckles 53 permit an adjustment of the position of outer frame member 55 to coincide with gate panel 56 in the closed position. These arms also provide an amount of springiness to prevent breakage of the movement mechanism in case the swinging gate 13 should encounter an obstruction in the course of its movement.

Figure 5:
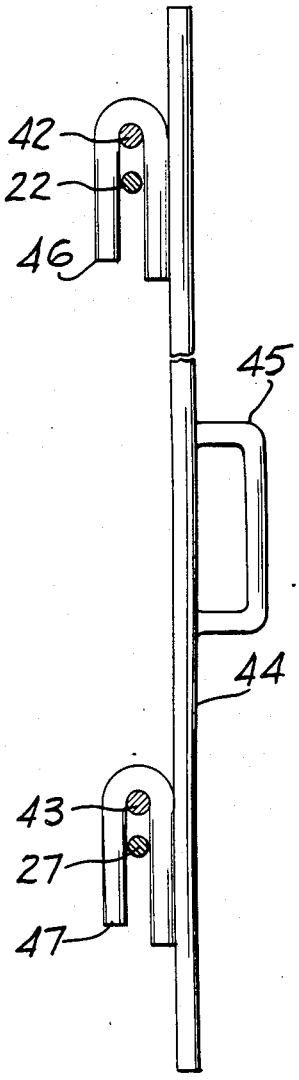
FIG. 5 is a front elevational view of the locking bar taken along line 5—5 of FIG. 4.

Used in conjunction with gate 13 is locking bar 44 to provide the flexibility of opening and closing gate 13 by remote control or manually. Locking bar 44 has two U-shaped loops 46 and 47 which are designed to fit easily and yet snugly over the respective combination of one of lugs 42 and 43 and one of L-shaped pins 22 and 27. Handle 45 is provided to permit easy manipulation of locking bar into or out of locking engagement. When locking bar 44 is in its locked position, as shown in FIG. 5, it will be seen that pin 22 and lug 42 as well as pin 27 and lug 43 will move together as though rigidly connected to each other. This means that as pins 22 and 27 are moved in the direction required by slots 23 and 28, lugs 42 and 43 will undergo the same movement. This causes arms 40 and 41 to follow that movement, which, in turn, swings gate 13 open or closed. When locking bar 44 is removed from contact with lugs 42 and 43 and L-shaped pins 22 and 27, gate 13 is free to swing on pivotal hangers 38 and 39. Thus, if one wishes to open gate 13 manually, it is only necessary to lift locking bar 44 off of its contact with lugs 42 and 43 and pins 22 and 27, and push open gate 13. When remote control is used, it is necessary that locking bar 44 be in engagement with lugs 42 and 43 and pins 22 and 27. The leverage of arms 40 and 41 results from the length of cross piece 50, which gives a power advantage to swinging a wide heavy gate solely from the movement of L-shaped pins 22 and 27 in slots 23 and 28. If gate 13 is not too wide, flexible cable can extend to outer frame member 55 (see FIG. 1), but if gate 13 is very wide, it is preferred to include an intermediate vertical frame member 54 at any convenient distance from inner frame member 35 which will provide sufficient leverage advantage. With locking bar 44 in place connecting lugs 42 and 43 to L-shaped pins 22 and 23 there is enough available movement in gate 13, due to the springiness of arms 40 and 41 by reason of the extension and contraction of springs 52 to open gate 13 manually at outer edge 55 sufficiently to permit a person to walk through, and upon release gate 13 will automatically return to its closed position aligned with gate 56.

It will be noted that depending on the width and weight of gate 13, the free swinging end, near outer frame member 55, will tend to sag and contact the ground or the gate stop, such as 14 of FIG. 1. For this reason it is preferred that slots 23 and 28 have a substantial portion of the lower extremity of the slot in a substantial vertical direction. This provides for the initial movement of gate 13, as it is being opened, to be upward so as to clear any obstruction such as the ground or the gate stop before the gate swings horizontally to be opened. The remaining length of slots 23 and 28 can be more horizontally directed to swing gate 13 to its open position. The exact configuration of slots 22 and 27 can, of course, be varied to meet any specific requirements. Generally it is preferred for the total radial angle of movement to be about 100°–130° to clear the opening for the passing of any vehicle.

If desired, gate 56 may also be fitted with a similar remote control opening mechanism. On the other hand, gate 56 is normally left in the closed position except for the passage of unusually wide vehicles, or other abnormal events. If gate 56 is only manually opened and closed, it frequently is fitted with a stop to prevent undesired swinging. A sliding rod, which drops into a recess in stop 14 or in the ground is a typical lock for such a gate.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A gate opening and closing device comprising a vertical cylindrical hollow gate post having a wall and two vertically spaced and aligned helical slots through said wall, a spindle rotatable and longitudinally slideable concentrically within said wall and extending substantially the same distance as the vertical distance between the centers of said slots, two L-shaped gate hanging pins each having a vertical and a horizontal leg with the end of said horizontal leg being rigidly connected to said spindle within said post and extending laterally outward through said respective slots, means attaching said gate to said vertical legs, electric power means for driving said spindle in vertical and rotatable directions, said power means including an extensible and retractable elongated rod and cylinder disposed within said gate post above and aligned said spindle, connecting means between the upper end portion of said spindle and said rod for positive affixation and driving thereof.

2. The device of claim 1 wherein the lower portion of said helical slots is substantially vertical.

3. The device of claim 1 wherein said helical slots extend in a radial direction between 100° and 130°.

4. The device of claim 1 wherein said gate post contains internally thereof and below the bottom end of said spindle a compression spring means adapted to bias said spindle upwardly when said L-shaped pins are located adjacent the lower portions of said slots.

5. The device of claim 1 further comprising a pair of spaced arms attached to said gate and having bearings engaged on respective said vertical legs, lug means connected to said bearings and extending toward and terminating short of said helical slot, and releasable means connecting said lug means to said L-shaped pins, respectively.

6. The device of claim 5 which includes a locking bar which is manually attachable or removable from a position connecting said lug means to said L-shaped pins.

7. The device of claim 5 wherein said arms are elongated horizontally positioned members attached to said gate at said bearing and at a horizontally spaced location adjacent the free swinging side of said gate, said arm between the two attachment locations including an adjustable spring tensioning portion.

8. The device of claim 7 wherein said arm comprises a bearing rigidly attached to the midportion of a yoke having two arms that diverge outwardly on two sides of said gate, a cross piece spreader connecting the ends of said two arms, a coil spring and a turnbuckle attached to each of said two arms, and an elongated flexible cable connected to both said turnbuckles and looped around a portion of said gate adjacent its free swinging side.

9. A gate opening and closing device comprising a vertical, tubular, cylindrical gate post having two vertically spaced helical slots through the wall of the tubular post, a spindle rotatable and longitudinally slideable concentrically inside said post and extending lengthwise about the same distance as the vertical space between corresponding portions of said slots, two L-shaped gate hanging pins each rigidly connected to said spindle and extending laterally outward through said respective slots with the free leg of the L being vertical and the leg attached to said spindle being horizontal, a gate supported by eye hangers fitting over the vertical legs of said L-shaped pins, two arms attached laterally parallel across a substantial portion of the width of said gate each having a bearing rotatably engaged to the vertical leg of said respective L-shaped pin with a projecting lug extending toward and in proximity to but not operatively engaged in said helical slot, a locking bar removeably positionable over each said lug and the horizontal leg of its respective L-shaped pin, a vertically reciprocable and rotatable rod member attached to said spindle and means for driving said rod member in a vertically reciprocating movement.

10. The device of claim 9 wherein the lower portion of said helical slots is substantially vertical.

11. The device of claim 9 wherein said helical slots extend in a radial direction between 100° and 130°.

12. The device of claim 9 wherein said gate post contains internally thereof and below the bottom end of said spindle a spring means adapted to be biased upwards against said spindle when said L-shaped pins are at the lower portions of said slots.

13. The device of claim 9 wherein said arms comprise a yoke member with said bearing at the central portion of the yoke and two yoke arms extending out each side of said gate to a cross piece extending through and substantially perpendicular to said gate, and a tie bar extending from each end of said cross piece to said gate adjacent the free vertical side.

14. The device of claim 13 wherein said tie bar comprises a length of flexible cable, a length of coil spring, and a turnbuckle.

15. The device of claim 9 wherein said locking bar comprises an elongated rod with a U-shaped hook portion attached thereto adjacent each end of said rod and positioned with the open side of the U facing downwards, said U being adapted to slide over said lug and said horizontal leg of the respective L-shaped pin.

16. A gate opening and closing device comprising a vertical, cylindrical, pipe gate post having an upper free end and a lower end affixed to the ground, two identically shaped and positioned helical slotted passageways through the wall of said post, one adjacent said upper end and the other adjacent said lower end; a cylindrical spindle radially rotatable and longitudinally slideable concentrically inside said post and extending lengthwise approximately the distance between corresponding portions of said two slots; two L-shaped pins rigidly attached to said spindle and extending horizontally outwardly through said respective slots with a free end of said pin positioned vertically upward; a gate panel having two parallel vertical edges, one being the inner edge adjacent said gate post and the other being the outer free swinging edge, and two horizontal edges, one being the top edge adjacent the upper free end of the gate post and the other being the bottom edge adjacent the ground, said gate having two eye hangers adjacent the inner edge and each positioned to fit longitudinally slideably and rotatably over the respective free ends of said L-shaped pins and adapted to permit said gate to pivot thereon to open and close; two lugs projecting outwardly from said inner edge of said gate, rigidly connected to said gate, vertically aligned respectively with the horizontal extensions of said L-shaped pins, and terminating short of engagement with said slots; a locking bar removeably engageable to operatively join each said lug to the respective horizontal extension of each said L-shaped pin; a reciprocable rotatable rod member attached to said spindle to cause said spindle to move vertically, and a power means to drive said rod member.

17. The device of claim 16 wherein said slots extend radially through an angle of 100°-130°.

18. The device of claim 16 wherein said slots are fashioned with the lower portion being substantially vertical

19. The device of claim 16 wherein said gate post is positioned with its lower end open and below ground level to permit water drainage therethrough.

20. The device of claim 16 wherein said gate post additionally includes an internal coil spring below the lower end of said spindle and adapted to be biased upwardly against said spindle when said spindle is in the lower part of its travel inside said gate post.

21. The device of claim 16 wherein said lug is attached to a harness device having a cylindrical bearing rotatably engaged with the vertical free end of said L-shaped pin, said bearing rigidly attached to a yoke having two diverging arms connected to the ends of a cross bar extending laterally through said gate, and an adjustable tension member extending from each end of said cross bar to said gate adjacent said outer free swinging edge.

22. The device of claim 21 wherein each said tension member includes an elongated flexible cable, an elongated coil spring, and a turnbuckle.

23. A gate opening and closing device comprising a vertical cylindrical hollow gate post having a wall and two vertically spaced and aligned helical slots through said wall, a spindle rotatable and longitudinally slideable concentrically within said wall and extending substantially the same distance as the vertical distance between the centers of said slots, a vertically reciprocable and rotatable rod member attached to said spindle, electric power means for driving said rod member, two L-shaped gate having pins each having a vertical and a horizontal leg with the latter leg being rigidly connected to said spindle and extending laterally outward through said respective slots, means attaching said gate to said vertical legs, said gate post containing internally thereof and below the bottom end of said spindle a compression spring means adapted to bias said spindle upwardly when said L-shaped pins are located adjacent the lower portions of said slots.

24. The device of claim 23 wherein the lower portion of said helical slots is substantially vertical.

25. The device of claim 23 wherein said helical slots extend in a radial direction between 100° and 130°.

26. The device of claim 23 further comprising a pair of spaced arms attached to said gate and having bearings engaged on respective said vertical legs, lug means connected to said bearings and extending toward and terminating short of said helical slot, and releasable means connecting said lug means to said L-shaped pins, respectively.

27. The device of claim 26 which includes a locking bar which is manually attachable or removable from a position connecting said lug means to said L-shaped pins.

28. The device of claim 26 wherein said arms are elongated horizontally positioned members attached to said gate at said bearing and at a horizontally spaced location adjacent the free swinging side of said gate, said arm being the two attachment locations including an adjustable spring tensioning portion.

29. The device of claim 28 wherein said arm comprises a bearing rigidly attached to the midportion of a yoke having two arms that diverge outwardly on two sides of said gate, a cross piece spreader connecting the ends of said two arms, a coil spring and a turnbuckle attached to each of said two arms, and an elongaged flexible cable connected to both said turnbuckles and looped around a portion of said gate adjacent its free swinging side.

30. The gate opening and closing device comprising a vertical cylindrical hollow gate post having a wall and two vertically spaced and aligned helical slots through said wall, a spindle rotatable and longitudinally slideable concentrically within said wall and extending substantially the same distance as the vertical distance between the centers of said slots, a vertically reciprocable and rotatable rod member attached to said spindle, electric power means for driving said rod member, two L-shaped gate hanging pins each having a vertical and a horizontal leg with the latter leg being rigidly connected to said spindle and extending laterally outward through said respective slots, means attaching said gate to said vertical legs, a pair of spaced arms attached to said gate and having bearings engaged on respective said vertical legs, lug means connected to said bearings and extending toward and terminating short of said helical slot, and releasable means connecting said lug means to said L-shaped pins, respectively.

31. The device of claim 30 which includes a locking bar which is manually attachable or removable from a position connecting said lug means to said L-shaped pins.

32. The device of claim 30 wherein said arms are elongated horizontally positioned members attached to said gate at said bearing and at a horizontally spaced location adjacent the free swinging side of said gate, said arm between the two attachment locations including an adjustable spring tensioning portion.

33. The device of claim 32 wherein said arm comprises a bearing rigidly attached to the midportion of a yoke having two arms that diverge outwardly on two sides of said gate, a cross piece spreader connecting the ends of said two arms, a coil spring and a turnbuckle attached to each of said two arms, and an elongated flexible cable connected to both said turnbuckles and looped around a portion of said gate adjacent its free swinging side.

* * * * *